US008783099B2

(12) United States Patent
Lilly et al.

(10) Patent No.: US 8,783,099 B2
(45) Date of Patent: Jul. 22, 2014

(54) DOWNHOLE SENSORS IMPREGNATED WITH HYDROPHOBIC MATERIAL, TOOLS INCLUDING SAME, AND RELATED METHODS

(75) Inventors: David H. Lilly, Houston, TX (US); Holger C. Stibbe, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 425 days.

(21) Appl. No.: 13/175,528

(22) Filed: Jul. 1, 2011

(65) Prior Publication Data

US 2013/0000399 A1 Jan. 3, 2013

(51) Int. Cl.
*E21B 47/06* (2012.01)

(52) U.S. Cl.
USPC ..... 73/152.51

(58) Field of Classification Search
USPC ..... 73/152.518, 152.51; 310/326, 327, 345
See application file for complete search history.

(56) References Cited

U.S. PATENT DOCUMENTS

| | | | | |
|---|---|---|---|---|
| 3,427,481 | A * | 2/1969 | Colbert et al. | 310/327 |
| 3,663,842 | A * | 5/1972 | Miller | 310/338 |
| 3,674,945 | A * | 7/1972 | Hands | 381/111 |
| 4,081,889 | A * | 4/1978 | Levine | 29/25.35 |
| 4,407,054 | A * | 10/1983 | Zipfel, Jr. | 29/25.35 |
| 4,422,003 | A * | 12/1983 | Safari et al. | 310/358 |
| 4,523,122 | A * | 6/1985 | Tone et al. | 310/334 |
| 5,130,950 | A | 7/1992 | Orban et al. | |
| 5,343,443 | A * | 8/1994 | Merewether | 367/152 |
| 5,798,488 | A | 8/1998 | Beresford et al. | |
| 6,262,517 | B1 | 7/2001 | Schmidt et al. | |
| 6,466,513 | B1 | 10/2002 | Pabon et al. | |
| 6,643,221 | B1 * | 11/2003 | Hsu et al. | 367/162 |
| 6,776,051 | B2 * | 8/2004 | Suzuki et al. | 73/861.27 |
| 6,788,620 | B2 * | 9/2004 | Shiraishi et al. | 367/152 |
| 6,995,500 | B2 | 2/2006 | Yogeswaren | |
| 7,036,363 | B2 | 5/2006 | Yogeswaren | |
| 7,069,775 | B2 * | 7/2006 | Fredette et al. | 73/152.18 |
| 7,075,215 | B2 | 7/2006 | Yogeswaren | |
| 7,087,264 | B2 * | 8/2006 | Suzuki et al. | 427/100 |
| 7,180,828 | B1 | 2/2007 | Sommer et al. | |
| 7,464,588 | B2 * | 12/2008 | Steinsiek | 73/152.55 |
| 7,467,558 | B2 * | 12/2008 | Fukuda et al. | 73/862.68 |
| 7,513,147 | B2 | 4/2009 | Yogeswaren | |

(Continued)

FOREIGN PATENT DOCUMENTS

EP 0672445 A1 9/1995

OTHER PUBLICATIONS

Ardebili et al., A Comparison of the Theory of Moisture Diffusion in Plastic Encapsulated Microelectronics with Moisture Sensor Chip and Weight-Gain Measurements, IEEE Transactions on Components and Packaging Technologies, vol. 25, No. 1, Mar. 2002, pp. 132-139.

(Continued)

*Primary Examiner* — John Fitzgerald
(74) *Attorney, Agent, or Firm* — TraskBritt

(57) ABSTRACT

A downhole tool includes a sensor having a sensitive component, a polymer that at least partially covers the sensitive component, and a hydrophobic material impregnated within the polymer and/or the sensitive component of the sensor. Methods of forming the downhole tool include covering a portion of the sensor with a polymer and impregnating a hydrophobic material within the polymer and/or the sensitive component of the sensor.

23 Claims, 6 Drawing Sheets

(56) References Cited

U.S. PATENT DOCUMENTS

| | | | | |
|---|---|---|---|---|
| 7,804,228 | B2 * | 9/2010 | Sadaka et al. | 310/334 |
| 7,825,568 | B2 | 11/2010 | Andle | |
| 8,286,475 | B2 * | 10/2012 | Nakajima et al. | 73/152.51 |
| 8,354,773 | B2 * | 1/2013 | Oliver et al. | 310/327 |
| 2002/0124662 | A1 * | 9/2002 | Suzuki et al. | 73/861.28 |
| 2004/0200056 | A1 * | 10/2004 | Suzuki et al. | 29/595 |
| 2005/0000279 | A1 * | 1/2005 | Yogeswaren | 73/152.58 |
| 2006/0185430 | A1 * | 8/2006 | Yogeswaren | 73/152.16 |
| 2009/0009035 | A1 * | 1/2009 | Yamashita et al. | 310/327 |
| 2009/0166037 | A1 | 7/2009 | Sroka | |

OTHER PUBLICATIONS

International Search Report for International Application No. PCT/US2012/044884 dated Dec. 27, 2012, 3 pages.

International Written Opinion for International Application No. PCT/US2012/044884 dated Dec. 27, 2012, 4 pages.

ASTM Standard D7334-08, "Standard Practice for Surface Wettability of Coatings, Substrates and Pigments by Advancing Contact Angle Measurement," (2008), pp. 1-3, ASTM Int'l, West Conshohocken, PA, US.

International Preliminary Report on Patentability for International Application No. PCT/US20121044884, dated Jan. 7, 2014, 6 pages.

* cited by examiner

DOWNHOLE SENSORS IMPREGNATED WITH HYDROPHOBIC MATERIAL, TOOLS INCLUDING SAME, AND RELATED METHODS

FIELD

Embodiments of the present disclosure relate to downhole tools comprising sensors, to sensitive components of such tools, and to methods of making such tools.

BACKGROUND

Wellbores are formed in subterranean formations for various purposes including, for example, extraction of oil and gas from the subterranean formation and extraction of geothermal heat from the subterranean formation. Sensors are employed to monitor conditions at downhole locations in the wellbores, either during drilling or after drilling. Examples of downhole characteristics that may be monitored using sensors include temperature, pressure, fluid flow rate and type, formation resistivity, cross-well and acoustic seismometry, perforation depth, fluid characteristics or logging data.

Sensors utilized at a drilling site may be incorporated within a drill string. A "drill string," as it is referred to in the art, comprises a series of elongated tubular segments connected end-to-end, and extends into the wellbore from a drilling rig or platform. An earth-boring rotary drill bit and other components may be coupled at the distal end of the drill string at the bottom of the wellbore being drilled. This assembly of tools and components is referred to in the art as a "bottom hole assembly" (BHA). Wirelines can also be used in a wellbore as part of drilling operations or during post-drilling operations. A "wireline" or "slickline," both terms used in the art, comprises a long wire, cable, or coil tubing often used to lower or raise downhole tools used in oil and gas well maintenance to the appropriate depth of the drilled well. Sensors may be incorporated within such wirelines.

Of the sensors utilized in drilling systems, acoustic sensors are common. In known systems, an acoustic sensor, typically with a piezo-ceramic transducer on board, operates in a pulse-echo mode in which it is utilized to both send and receive a pressure pulse in drilling fluid (also referred to as drilling mud). In such systems, the transmitter and receiver of the acoustic sensor are integrated together. In other known systems, an acoustic sensor includes an acoustic receiver configured to detect a signal resulting from a signal transmitted by a separate acoustic transmitter. In such systems, the acoustic sensor transmitter may be located nearby the acoustic sensor receiver or arrayed down the length of the downhole tool from the receiver incorporated within the tool. In use, an electrical drive voltage (e.g., a square wave pulse) is applied to the transducer of the acoustic sensor transmitter, which vibrates the surface of the transducer of the transmitter and launches a pressure pulse into the drilling fluid. A portion of the ultrasonic energy is typically reflected at the drilling fluid/borehole wall interface and is received by the transducer of the acoustic sensor receiver, which induces an electrical response therein. In systems having an acoustic sensor with an integrated receiver and transmitter, the transducer launching the pressure pulse may be the transducer that also receives the response. Various characteristics of the downhole environment may be inferred from the received signal, such as the borehole diameter, measure eccentricity, and drilling-fluid properties.

Conditions in a downhole environment are often harsh. Sensors used downhole must typically withstand temperatures ranging to and beyond 150 degrees Celsius and pressures ranging up to about 30,000 psi. Surrounded by earth, debris, and drilling mud, downhole conditions are often also moisture-filled spaces, yet, sensors may have sensitive components that can be damaged when coming into contact with water. For example, in an acoustic sensor employing a piezoelectric ceramic transducer, exposure of the ceramic material to moisture at high pressures and temperatures makes the ceramic transducer vulnerable to water diffusion therein, which may alter the capacitance and the dielectric constant of the ceramic material. Such alterations compromise the sensor's ability to detect signals accurately.

Attempts have been made to reduce the likelihood of exposure of the sensitive components of sensors to potentially damaging conditions. Such attempts include surrounding the sensitive components of the sensor with a material, such as silicone oil. Examples of such use of protective surrounds are disclosed in, for example, U.S. Pat. No. 7,036,363, which issued May 2, 2006, to Yogeswaren; U.S. Pat. No. 7,075,215, which issued Jul. 11, 2006, to Yogeswaren; U.S. Pat. No. 7,180,828, which issued Feb. 20, 2007, to Sommer et al.; and U.S. Pat. No. 7,825,568, which issued Nov. 2, 2010, to Andle.

BRIEF SUMMARY

In some embodiments, the present disclosure includes a downhole tool having a sensor. The sensor has a sensitive component. A polymer at least partially covers the sensitive component. The polymer is impregnated with a hydrophobic material.

In some embodiments, the present disclosure includes a downhole tool having a sensor. The sensor has a sensitive component. A polymer at least partially covers the sensitive component. The sensitive component is impregnated with a hydrophobic material.

The present disclosure includes a method of forming a downhole tool. Some embodiments of the method include covering the sensitive component of a sensor with a polymer and impregnating the polymer with a hydrophobic material.

In some embodiments of the method of forming a downhole tool, the method includes covering a sensitive component of a sensor with a polymer and impregnating the sensitive component of the sensor with a hydrophobic material.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1:
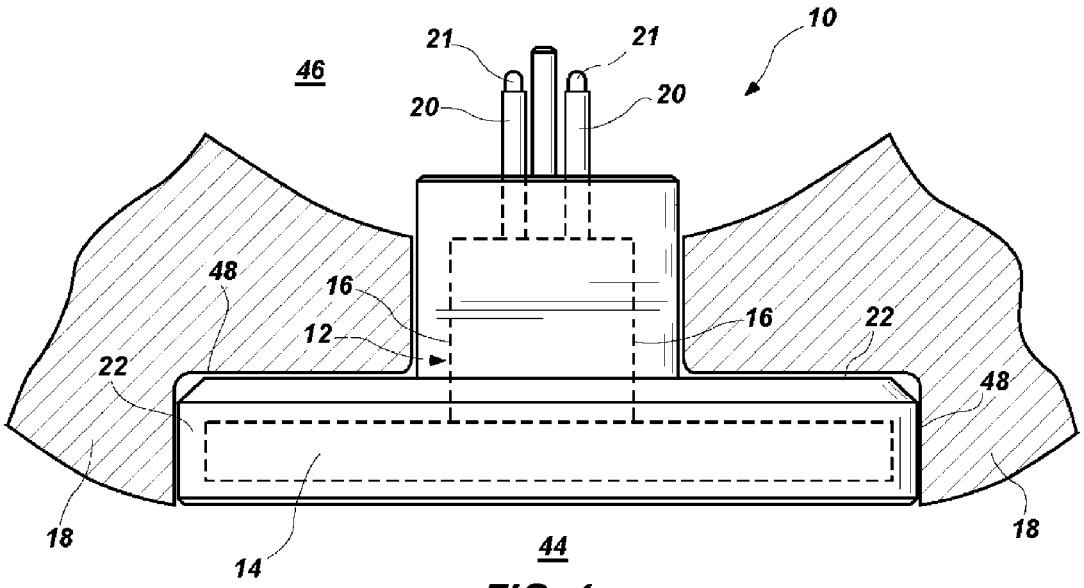
FIG. 1 is an elevation view of a schematic representation of a sensor of the present disclosure in a partial view of a downhole tool segment supporting the sensor.

The illustrations presented herein are not actual views of any particular tool, downhole tool or system, sensor, or component of such a tool, system, or sensor, but are merely idealized representations employed to describe embodiments of the present disclosure.

As used herein, the term "sensor" means and includes a device that responds to a physical condition and transmits a signal as a function of that condition. For example, sensors may be configured to detect pressures, flow rates, temperatures, etc., and may be configured to communicate with other parts of a system, such as a drill string (e.g., a control system). "Sensor" may also include, without limitation, an acoustic sensor transmitter, an acoustic sensor receiver, and an acoustic sensor with integrated transmitter and receiver.

As used herein, "drilling system" means and includes any grouping of inter-communicable or interactive tools configured for use in testing, surveying, drilling, completing, sampling, monitoring, utilizing, maintaining, repairing, etc., a bore. Drilling systems include, without limitation, on-shore systems, off-shore systems, systems utilizing a drill string, and systems utilizing a wireline.

As used herein, the term "downhole tool" means and includes any tool used within a wellbore in a subterranean formation. Downhole tools include, without limitation, tools used to measure or otherwise detect conditions in the downhole environment and tools used to communicate conditions to uphole locations.

As used herein, the term "earth-boring tool" means and includes any tool used to remove formation material and form a bore (e.g., a wellbore) through a formation by way of the removal of a portion of the formation material. Earth-boring tools include, without limitation, rotary drill bits (e.g., fixed-cutter or "drag" bits and roller cone or "rock" bits), hybrid bits including both fixed cutters and roller elements, coring bits, percussion bits, bi-center bits, casing mills and drill bits, exit tools, reamers (including expandable reamers and fixed-wing reamers), and other so-called "hole-opening" tools.

As used herein, the term "high-pressure" refers to pressures at or exceeding 10,000 psi.

As used herein, the term "high-temperature" refers to temperatures at or exceeding 100 degrees Celsius.

As used herein, the term "hydrophobic" means and includes any material or surface with which water droplets have a contact angle in air of at least 90°, as measured by a contact angle goniometer as described in ASTM Standard D7334-08 (Standard Practice for Surface Wettability of Coatings, Substrates and Pigments by Advancing Contact Angle Measurement, ASTM Intl, West Conshohocken, Pa., 2008), which standard is incorporated herein in its entirety by this reference. Hydrophobic materials include, for example, silicon-based oils (commonly termed "silicone oils"), non-polar silicones, and fluorocarbons.

As used herein, the term "silicone oil" means and includes any polymerized siloxane with organic side chains. Silicone oil includes, for example, polydimethylsiloxane fluid.

In some embodiments, the disclosure includes a downhole tool comprising a sensor having a sensitive component configured for use in a downhole environment. The sensor is at least partially covered by a polymer, and either or both of the sensitive component and polymer are impregnated with a hydrophobic material. The impregnated hydrophobic material may discourage or prevent moisture or other contaminants from diffusing into and through the polymer and/or sensitive component and subsequently compromising the functionality of the sensor's sensitive component.

FIG. 1 illustrates an embodiment of a downhole tool having a downhole tool segment 4 (FIGS. 4 and 5) that houses at least one sensor 10 according to an embodiment of the present disclosure. The sensor 10 has a body 12 that defines at least one sidewall 16. The sensor 10 includes at least one sensitive component 14 that is supported by the body 12 of the sensor 10. According to the depicted embodiment, the sidewall 16 of the body 12 is substantially cylindrical.

The sensitive component 14 of the sensor 10 of the downhole tool may be the condition-sensing component of an acoustic sensor, e.g., a piezoelectric transducer, generally or, more specifically, a piezoelectric ceramic transducer. According to the depicted sensor 10, the sensitive component 14 defines a circular face with a circumference greater than the circumference defined by the cylindrical sidewall 16. In other aspects, the sensitive component 14 of the sensor 10 includes a plurality of stacked piezoelectric transducers.

Also as FIG. 1 illustrates, a polymer 22 covers the sensitive component 14 and at least partially covers the body 12 of the sensor 10. The polymer 22 may be, without limitation, an elastomer, an acrylic, an epoxy, a resin, a thermoplastic material, or, more specifically, polyetheretherketone (PEEK). The polymer 22 may be configured to completely cover the sensitive component 14 of the sensor 10, leaving none of the sensitive component 14 exposed. Alternatively, the polymer 22 may be configured to cover the entirety of the sensitive component 14 of the sensor 10 as well as part of the sidewall 16 of the body 12 of the sensor 10. Alternatively, the polymer 22 may be configured to encapsulate the entirety of the body 12 of the sensor 10, including the sensitive component 14, as depicted.

According to the depiction in FIG. 1, the polymer 22 tightly covers the surface of the sensitive component 14 and the body 12 of the sensor 10. The polymer 22 may be affixed to the covered portions of the sensitive component 14 and/or the body 12 of the sensor 10. The polymer 22 may be removably connected to the covered portions of the sensitive component 14 and/or the body 12 of the sensor 10. Further, the polymer 22 may be configured so as to be distributed evenly along the external surface of the body 12 of the sensor 10, including the sensitive component 14 of the sensor 10, such that the polymer 22 has a uniform thickness in the covered areas.

The polymer 22 of the sensor 10 may be impregnated with a hydrophobic material 28. The hydrophobic material 28 may be a silicone oil, such as polydimethylsiloxane, or another siloxane, such as methylpolysiloxane. The hydrophobic material 28 may be alternatively comprise a fluoropolymer such as polytetrafluoroethylene. Being impregnated with the hydrophobic material 28, the impregnated polymer 22 is configured such that the hydrophobic material 28 occupies otherwise-void space between the compounds within the polymer 22. Accordingly, when the impregnated polymer 22 is exposed to a moisture-rich environment, void space within the polymer 22, which may otherwise be accessible to and thereafter occupied by water molecules or the like, will already be occupied by the hydrophobic material 28. The prior occupation of the otherwise-void space by the hydrophobic material 28 may therefore discourage moisture diffusion into and through the polymer 22.

For example, an acoustic sensor, having a piezoelectric ceramic transducer that is at least partially covered with a PEEK polymer 22 may be exposed to a high-pressure, high-temperature, and moisture-filled downhole environment. In such conditions, the PEEK material may be subjected to deforming forces and made vulnerable to diffusion of water into and through the PEEK material. The diffused water may take up residence within the void space between the molecules comprising the PEEK material. The diffused water molecules may further diffuse completely through the PEEK material to access and diffuse into the piezoelectric ceramic transducer of the covered acoustic sensor. The contact of this sensitive component 14 of the sensor 10 with the water may alter the capacitance of the piezoelectric ceramic transducer, alter the dielectric constant of the ceramic material, and prevent the sensor from accurately detecting that which it is meant to detect. However, an acoustic sensor, having a piezoelectric ceramic transducer that is at least partially covered with PEEK impregnated with a hydrophobic material 28, such as silicone oil, may be less prone to moisture diffusing therethrough, even under high-pressure, high-temperature conditions in a downhole environment. Therefore, the sensitive component 14 of the acoustic sensor may not come into contact with the moisture of the downhole environment. As such sensitive components 14 may be more likely to continue to accurately detect signals in the harsh environment compared to sensitive components 14 of a sensor covered by a PEEK material that is not impregnated with a hydrophobic material 28. Accordingly, the disclosed sensor 10 is configured to detect a signal, such as an acoustic pulse, in an environment at a pressure of at least 30 kpsi and at a temperature of at least 175 degrees Celsius (e.g., in a downhole environment at 30 kpsi and 175 degrees Celsius, at 33 kpsi and 175 degrees Celsius, at 30 kpsi and 185 degrees Celsius, and at other pressures and temperatures within such range or the vicinity thereof). It is further configured to detect a signal in an environment below a pressure of 30 kpsi and at a temperature lower than 175 degrees Celsius.

Figure 2:
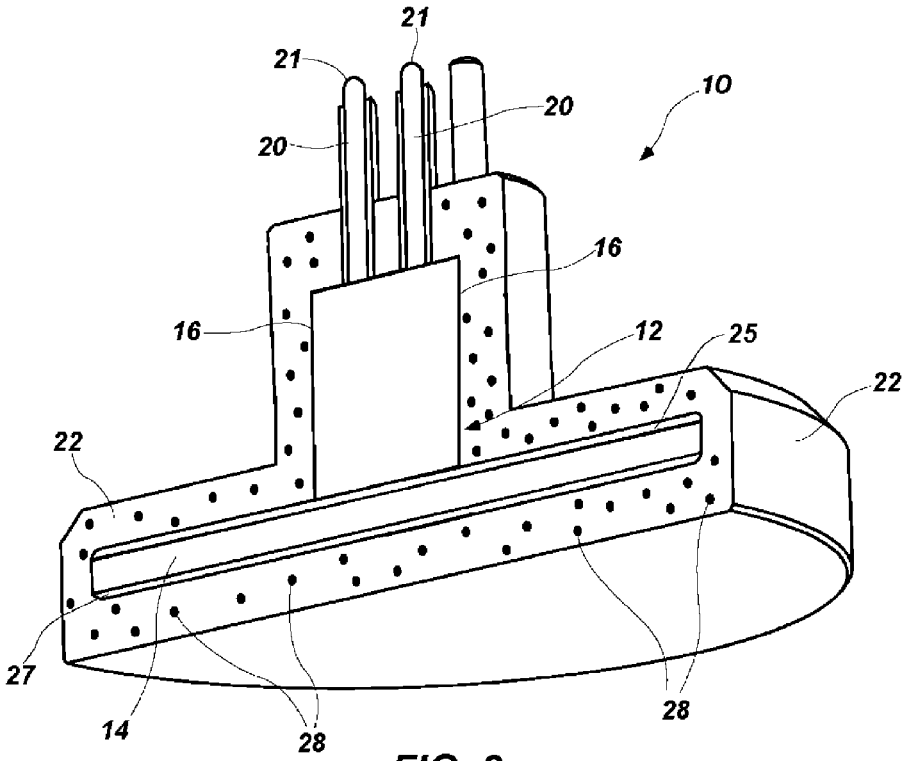
FIG. 2 is a cross-sectional, perspective view of a schematic representation of a sensor of the present disclosure, comprising a sensitive component covered with a polymer impregnated with a hydrophobic material.

FIG. 2 depicts a cross-sectional view of a sensor 10 illustrated by FIG. 1. In aspects such as that illustrated in FIG. 2, the hydrophobic material 28 is evenly dispersed throughout the polymer 22. In other aspects of the sensor 10, the hydrophobic material 28 is dispersed more densely in the vicinity of the sensitive component 14 of the sensor 10 and less densely in the parts of the polymer 22 that are distant from the sensitive component 14. In still other aspects, the hydrophobic material 28 impregnated within the polymer 22 may be more densely dispersed near the external surface of the polymer 22 and less densely dispersed near to the internal surface of the polymer 22 abutting the covered body 12 of the sensor 10. In still other aspects, the hydrophobic material 28 impregnated within the polymer 22 is more densely dispersed near to the internal surface of the polymer 22 abutting the sensitive component 14 of the sensor 10 and less densely dispersed near to the external surface of the polymer 22.

Figure 3:
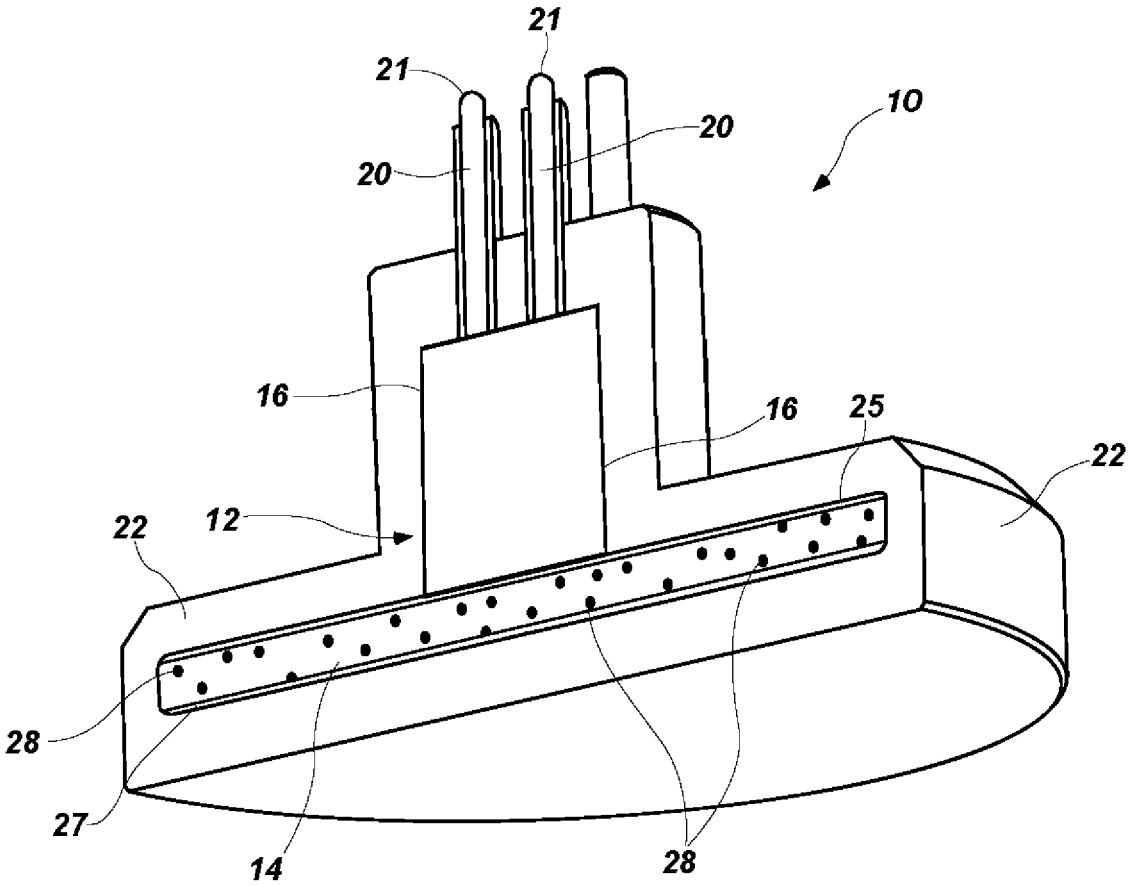
FIG. 3 is a cross-sectional, perspective view of a schematic representation of a sensor of the present disclosure, comprising a sensitive component impregnated with a hydrophobic material and covered by a polymer.

FIG. 3 illustrates a cross-sectional view of another aspect of a sensor 10 illustrated by FIG. 1. The depicted sensor 10 includes a sensitive component 14 impregnated with a hydrophobic material 28. The sensitive component 14 may comprise a porous material, such as a porous ceramic. The hydrophobic material 28 may be impregnated into the pores of the porous material of the sensitive component 14. The impregnated sensitive component 14 is covered, at least partially, by a polymer 22. In some aspects, the covering polymer 22 is not impregnated with a hydrophobic material 28. In other aspects, the covering polymer 22 is impregnated with a hydrophobic material 28. In some such aspects, the hydrophobic material 28 impregnated into the polymer 22 covering the impregnated sensitive component 14 is a hydrophobic material 28 of the same composition of the hydrophobic material 28 impregnated within the sensitive component 14. In other such aspects, the hydrophobic material 28 impregnated into the polymer 22 covering the impregnated sensitive component 14 is a hydrophobic material 28 of a different composition than the hydrophobic material 28 impregnated within the sensitive component 14.

Figure 4:
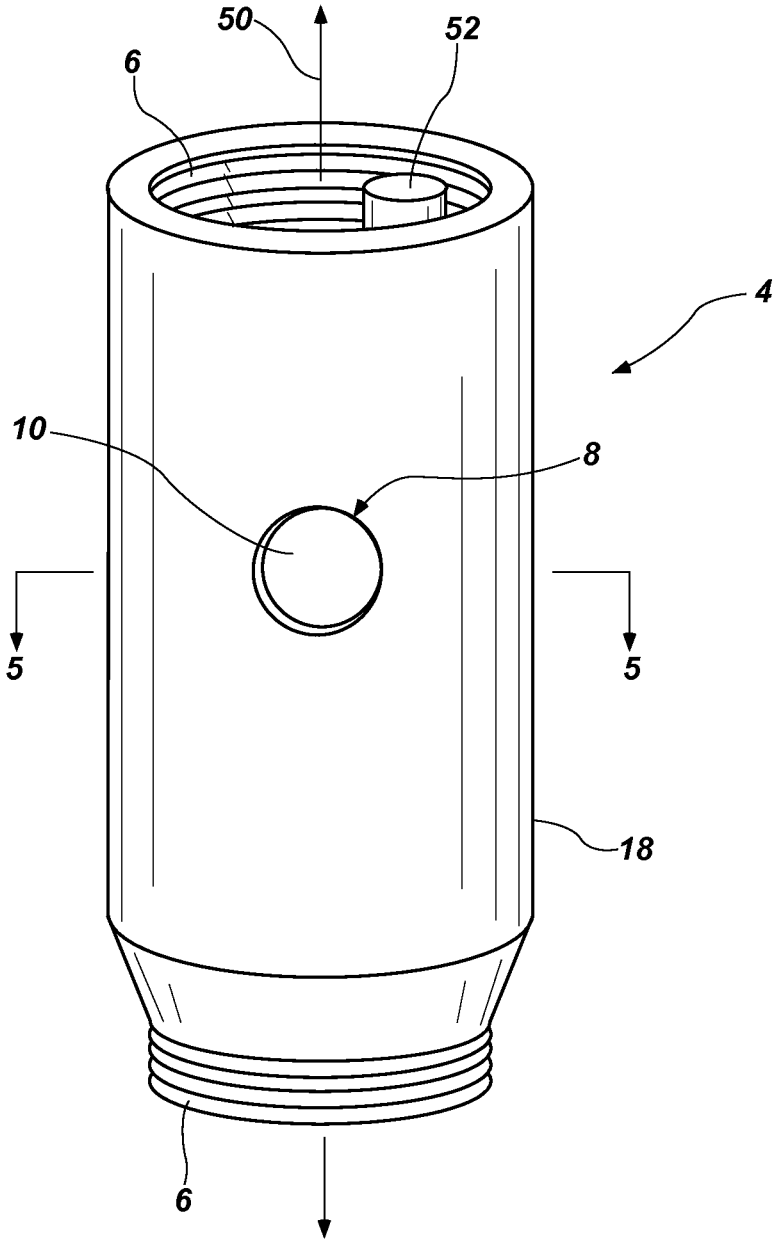
FIG. 4 is a schematic representation of a downhole tool segment including at least one sensor of the present disclosure.

FIG. 4 illustrates an embodiment of a downhole tool segment 4. The downhole tool segment 4 of FIG. 4 is substantially cylindrical, being largely symmetrical about cylindrical axis 50 (also referred to as a longitudinal axis). Downhole tool segment 4 includes a substantially-cylindrical sensor housing 18 configured for coupling to a drill string 36 (FIG. 7) or wireline 37 (FIG. 6) and therefore may include threaded end portions 6 for coupling to a drill string 36 or wireline 37. Through pipe 52 provides a conduit for the flow of drilling fluid downhole, for example, to a drill bit assembly having a drill bit 34 (FIG. 7).

The sensor housing 18 defines therein at least one aperture 8 bordered by housing opening edges 48 (FIG. 1). A sensor 10 is situated in an aperture 8 and is supported by the sensor housing 18. The sensor 10 is configured to communicate transmitted and received signals between the sensor 10 and a downhole location 40 via the aperture 8. Downhole tool segment 4 includes at least one, and may include three or more, sensors 10 having a sensitive component 14.

Figure 5:
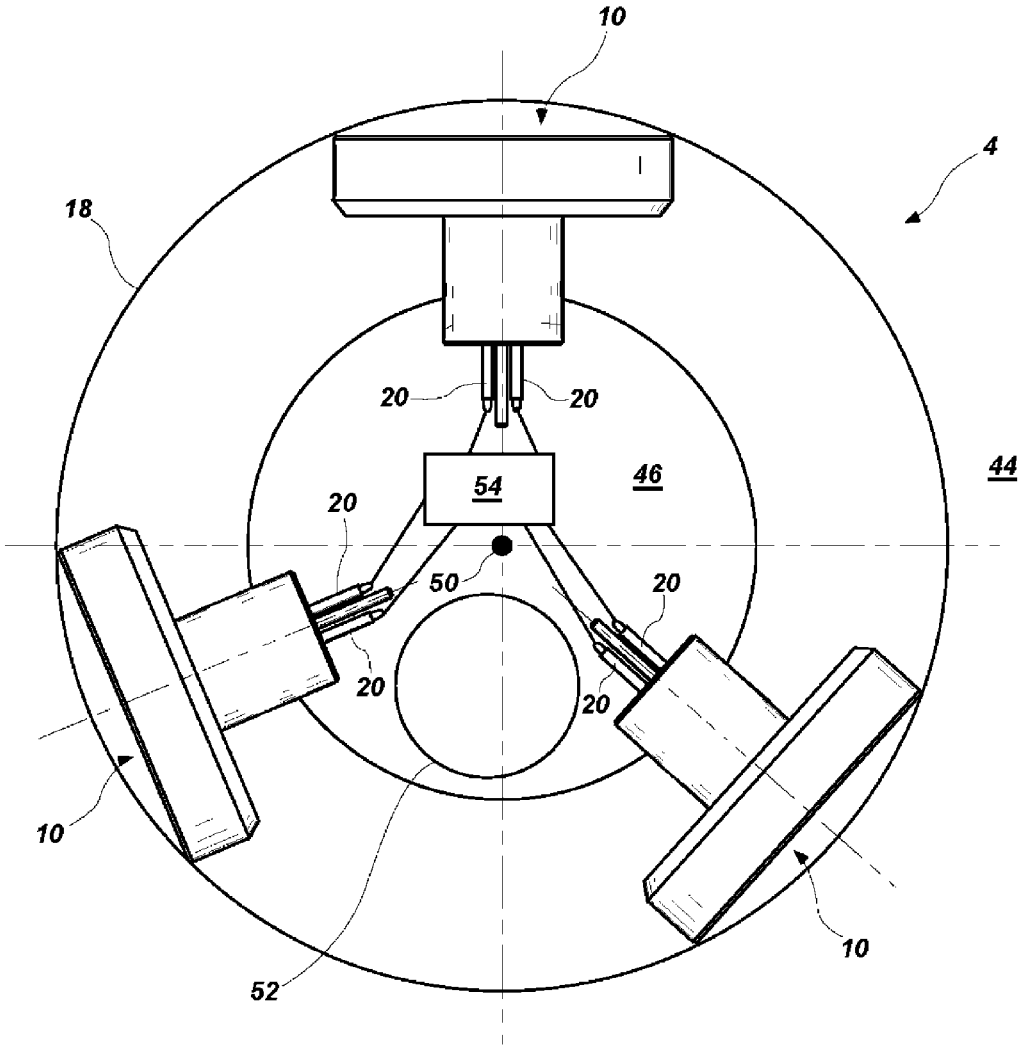
FIG. 5 is a cross-sectional view of a schematic representation of section 5-5 of FIG. 4.

FIG. 5 illustrates a cross-sectional view of a schematic of the downhole tool segment 4 shown in FIG. 4, taken along section 5-5. The depicted downhole tool segment 4 includes three sensors 10. The invention is not limited to any particular number or orientation of sensors that may be deployed at one time. According to the embodiments depicted in FIGS. 1 through 5, each sensor is positioned such that the sensitive component 14 of the sensor 10 is directed toward and is in communication with an exterior 44 of the downhole tool segment 4. Further, each sensor may snugly abut the housing opening edges 48. In such a configuration, the widest external dimension of the polymer 22 surrounding the face of the sensor's sensitive component 14 snugly abuts the widest internal dimension defined by the aperture 8 in the sensor housing 18. Each sensor may be sealed within the sensor housing 18 to substantially prevent the flow of drilling fluid from the exterior 44 of the downhole tool segment 4 from entering through the aperture 8 to an interior 46 of the downhole tool segment 4. In such aspects of the downhole tool segment 4, the seal between each sensor 10 and the sensor housing 18 may form a fluid-tight seal between the polymer 22 covering the sensor 10 and the housing opening edges 48 of the sensor housing 18.

In use, the exterior 44 of the downhole tool segment 4 may be at a high-temperature and high-pressure. The interior 46 of the downhole tool segment 4 may be at a lower temperature and pressure, such as atmospheric pressure.

In some embodiments, such as that depicted in FIGS. 1 through 3 and 5, the polymer 22 seamlessly encapsulates the entirety of the body 12 of the sensor 10 and/or the entirety of the sensitive component 14 of the sensor 10. In other aspects, the polymer 22 covers only the majority of the sensor body 12.

With reference to FIGS. 2 and 3, the sensor 10 also includes electrical contacts 20 operatively connected with the sensitive component 14. According to the sensor 10 depicted, each of the electrical contacts 20 is in electrical communication with one of a pair of metallic layers 25, 27 situated such that the sensitive component 14 is positioned between the top metallic layer 25 and the bottom metallic layer 27. Connector pins 21 are configured to connect the electrical contacts 20 of the sensor 10 to an electronics module, such as a controller 54 (FIG. 5). The controller 54 may include conventional electrical drive voltage electronics (e.g., a high voltage, high frequency power supply) for applying a waveform (e.g., a square wave voltage pulse) to a piezoelectric ceramic transducer, which causes the transducer to vibrate and thus launch a pressure pulse into the drilling fluid external to the downhole tool segment 4. The controller 54 may also or alternatively include receiving electronics, such as a variable gain amplifier for amplifying a relatively weak received signal (as compared to the transmitted signal). The receiving electronics within the electronics module may also include various filters (e.g., low and/or high pass filters), rectifiers, multiplexers, and other circuit components for processing the detected signal.

The electronics module or controller 54 may also include a programmable processor (not shown), such as a microprocessor or microcontroller, and may also include processor-readable or computer-readable program code embodying logic, including instructions for controlling the function of the sensors 10. A controller 54 may also optionally include other controllable components, such as additional sensors, data storage devices, power supplies, timers, and the like. The controller 54 may also be disposed to be in electronic communication with various sensors and/or probes for monitoring physical parameters of a wellbore 38, such as a gamma ray sensor, a depth detection sensor, or an accelerometer. Controller 54 may also optionally communicate with other instruments in the drill string 36, wireline 37, or drilling system 30, such as telemetry systems that communicate with the surface. Controller 54 may further optionally include volatile or non-volatile memory or a data storage device. Further, while the controller 54 of FIG. 5 is shown disposed within downhole tool segment 4, it may alternatively be disposed elsewhere in the drill string 36, wireline 37, or drilling system 30.

With further reference to FIG. 5, the electrical contacts 20 of multiple sensors 10 may be in operable connection with a controller 54. These electrical contacts 20 may be configured to communicate detected conditions to the controller 54 or to other aspects within the drilling system 30 utilizing the sensor 10. During use, conditions sensed by the sensor 10 are communicable to the controller 54. Depending upon the condition detected, adjustments to the operation of the drilling system 30 (FIGS. 6 and 7) may be made.

Figure 6:
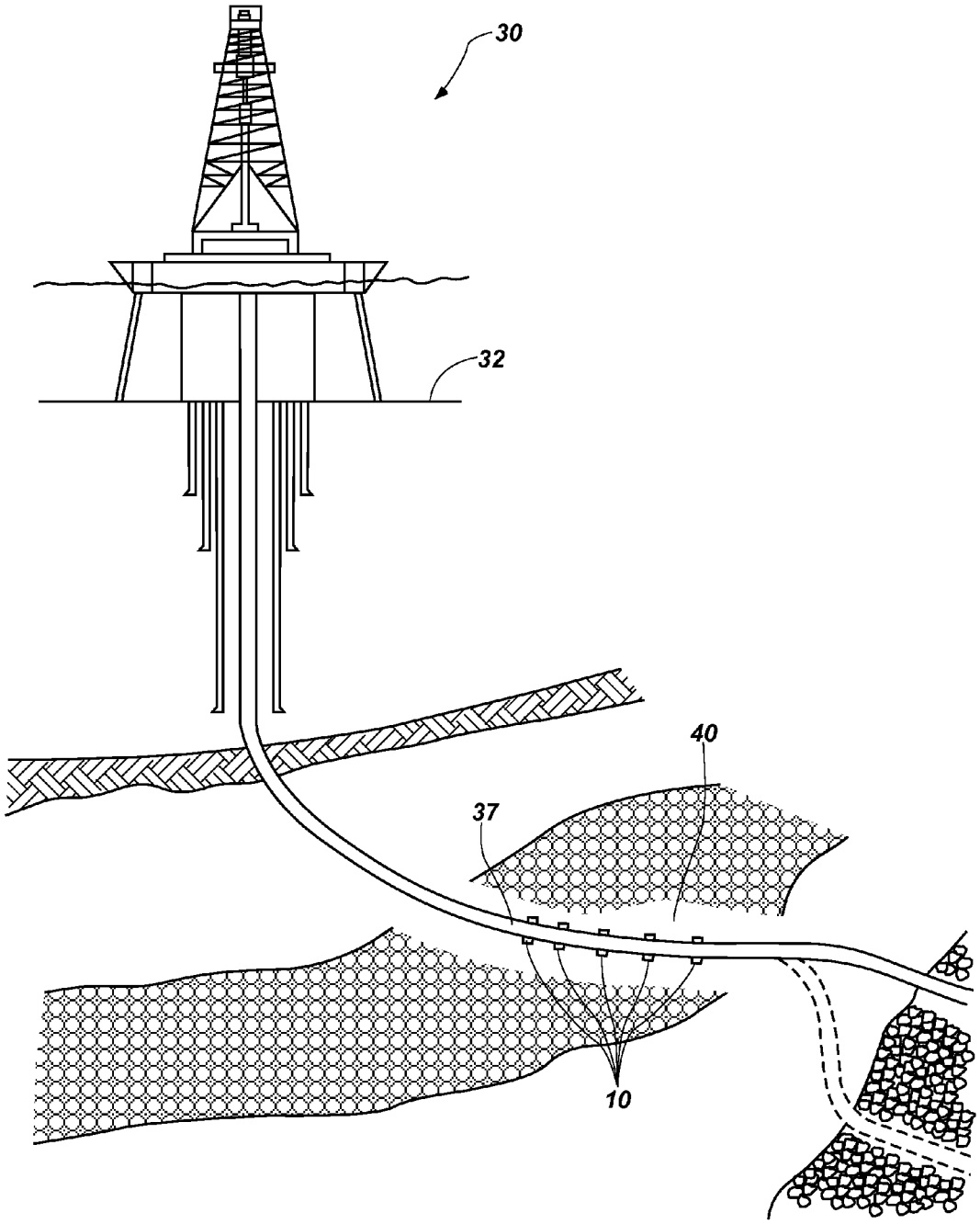
FIG. 6 is a schematic representation of a drilling system, utilizing a wireline, incorporating a plurality of sensors of the present disclosure.
Figure 7:
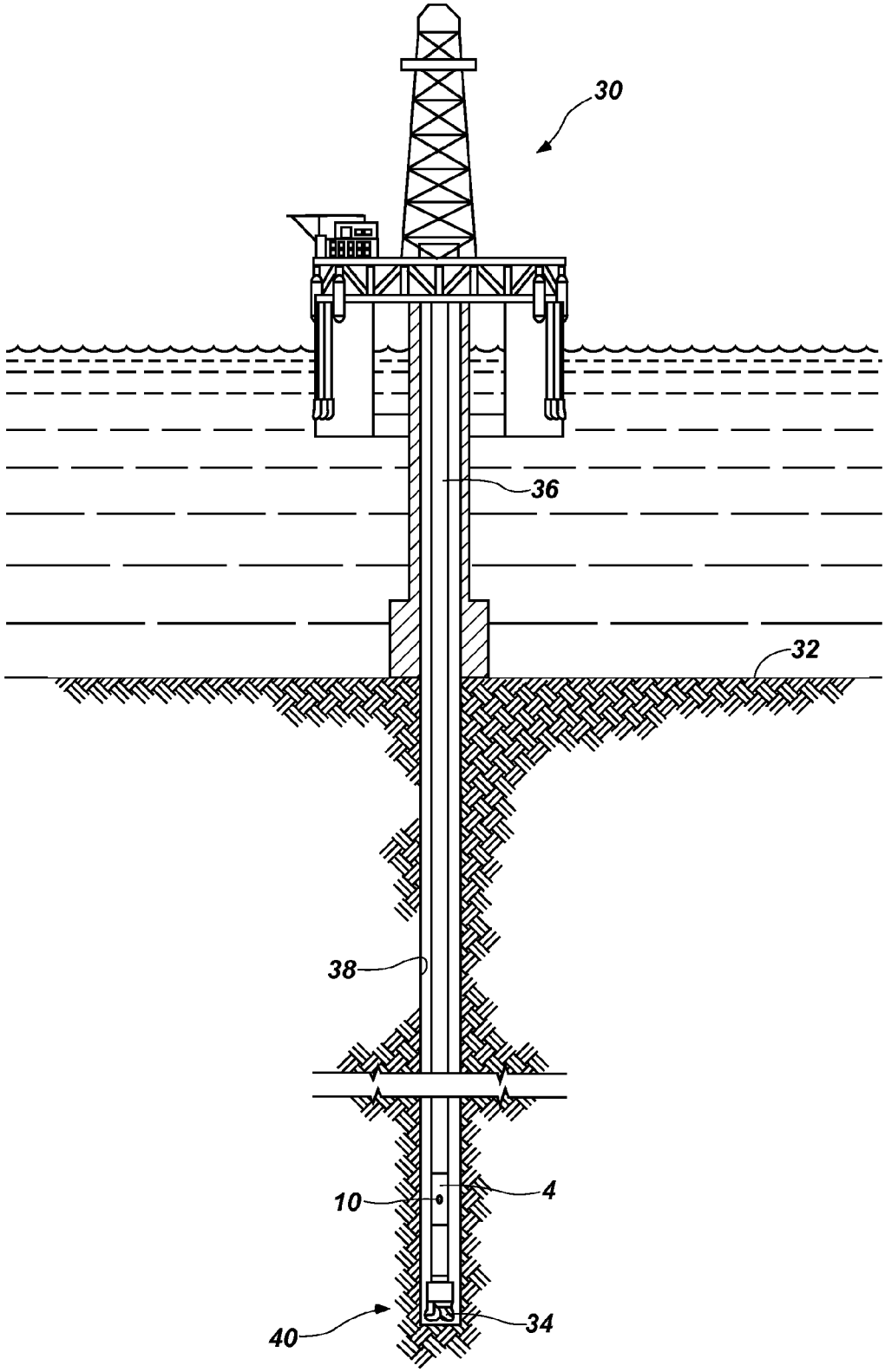
FIG. 7 is a schematic representation of a drilling system, utilizing a drill string, incorporating a plurality of sensors of the present disclosure.

FIG. 6 illustrates an example of a drilling system 30 in which sensors 10 of the present disclosure may be utilized. The depicted drilling system 30 includes a wireline 37 extending into a wellbore 38 (FIG. 7) from an earthen surface 32. According to FIG. 6, the earthen surface 32 is an off-shore location, but, in other aspects, the earthern surface 32 may be an on-shore location. The wireline 37 of the depicted drilling system 30 includes several active devices, such as multiple sensors 10 aligned along a portion of the line and situated within a downhole location 40.

FIG. 7 illustrates another example of a drilling system 30 in which sensors 10 of the present disclosure may be utilized. The depicted drilling system 30 includes a drill string 36 extending into a wellbore 38 from an earthen surface 32. A downhole tool segment 4, housing one or more sensors, is included along the drill string 36. An earth-boring tool, such as a drill bit 34 or reamer, is also coupled to the drill string 36. The drill string 36 may further include other active devices, such as a downhole drill motor and one or more additional sensors for sensing downhole characteristics of the wellbore 38 and the surrounding formation.

In some aspects, the disclosure includes methods of forming a downhole tool. The method of forming a downhole tool may include forming a sensor 10 having a body 12 that defines at least one sidewall 16. Forming a sensor 10 may also include forming a sensitive component 14 supported by the body 12 of the sensor 10. Alternately, the sensor 10 may be formed using methods known in the art. The sensitive component 14 of the sensor may also be formed using methods known in the art.

The method for forming a downhole tool further includes covering at least a portion of the sensor 10, such as the sensitive component 14, with a polymer 22. Covering a portion of the sensor 10 may include forming a polymer 22 and applying the polymer 22 to the surface of the sensor's body 12. The polymer 22 may be formed using methods known in the art, such as by injection molding, blow molding, reaction injection molding, rotational molding, thermoforming (e.g., pressure forming, vacuum forming), thermoplastic compression molding, twin-sheet forming, dip coating, etc. Applying the polymer 22 to the surface of the sensor's body 12 may be accomplished during the formation of the polymer 22 or by first forming the polymer 22 separately and then applying the formed polymer 22 around at least a portion of the sensor body 12.

The method for forming a downhole tool further includes impregnating the polymer 22 with a hydrophobic material 28. The polymer 22 may be impregnated with the hydrophobic material 28 either before covering at least a portion of the sensor body 12 with the impregnated polymer 22 or after covering at least a portion of the sensor body 12 with non-impregnated polymer 22. Impregnating the polymer 22 with the hydrophobic material 28 may be accomplished by conventional means for impregnating a polymer with a second material, such as a hydrophobic fluid.

One example for forming a downhole tool includes, at least in some aspects, selecting a polymer 22 and at least partially subjecting the polymer 22 to a hydrophobic material 28, as by immersing a portion of the polymer 22 within the hydrophobic material 28. As a more particular example, in some aspects, the polymer 22, covering at least a portion of the sensor 10, may be submerged within a reservoir containing the hydrophobic material 28 at high-pressure and at high-temperature. In some such aspects, the polymer 22 is submerged within a bath of silicone oil, the pressure within the bath is brought to 30 kpsi, and the temperature within the bath is raised to 185 degrees Celsius. At such a high-pressure and high-temperature, the hydrophobic material 28 may diffuse into the polymer 22 and occupy what were spatial voids therein. Thereafter, should the impregnated polymer 22 be exposed to high-pressure and high-temperature conditions in a moisture-filled environment, the otherwise-vacant areas occupied by the hydrophobic material 28 will no longer be available to receive or house diffused water molecules. Accordingly, the covered sensitive components 14 of the sensor 10 within the polymer 22 may be shielded from unwanted contact with moisture.

In other aspects, the disclosed method for forming a downhole tool, such as a sensor 10, involves impregnating a sensitive component 14 of the sensor 10 with a hydrophobic material 28. Again, the sensor 10 may be an acoustic sensor having a sensitive component 14 involving a piezoelectric ceramic transducer. The hydrophobic material 28 may be a siloxane material (e.g., silicone oil, polydimethylsiloxane, methylpolysiloxane) or a fluoropolymer (e.g., polytetrafluoroethylene).

The method for forming a downhole tool, such as a sensor 10, may further include covering the impregnated sensitive component 14 of the tool with a polymer 22. The method may further include impregnating the covering polymer 22 with a hydrophobic material 28. In some such aspects of the method, the covering polymer 22 may be impregnated with the hydrophobic material 28 before the covering of the sensor 10 with the polymer 22 or subsequent to the covering of the sensor 10 with the polymer 22. The hydrophobic material 28 impregnated within the covering polymer 22 may be of the same or of a different composition than the hydrophobic material 28 impregnated within the sensitive component 14.

Additional non-limiting example embodiments of the disclosure are described below.

Embodiment 1

A downhole tool, comprising a sensor, the sensor comprising a sensitive component; a polymer at least partially covering the sensitive component; and a hydrophobic material impregnated within the polymer.

Embodiment 2

The downhole tool of Embodiment 1, wherein the sensor comprises an acoustic sensor.

Embodiment 3

The downhole tool of Embodiment 2, wherein the sensitive component comprises a piezoelectric ceramic transducer.

Embodiment 4

The downhole tool of any of Embodiments 1 through 3, wherein the polymer comprises a thermoplastic material.

Embodiment 5

The downhole tool of Embodiment 4, wherein the thermoplastic material comprises polyetheretherketone.

Embodiment 6

The downhole tool of any of Embodiments 1 through 5, wherein the hydrophobic material comprises silicone oil.

Embodiment 7

The downhole tool of any of Embodiments 1 through 6, wherein the sensor is configured to detect a signal in an environment at a pressure of at least 30 kpsi and at a temperature of at least 175 degrees Celsius.

Embodiment 8

A method of forming a downhole tool comprising forming a sensor having a sensitive component; covering the sensitive component with a polymer; and impregnating the polymer with a hydrophobic material.

Embodiment 9

The method of Embodiment 8, wherein covering the sensitive component with the polymer precedes impregnating the polymer with the hydrophobic material.

Embodiment 10

The method of any of Embodiments 8 and 9, wherein covering the sensitive component with the polymer comprises covering the sensitive component with polyetheretherketone.

Embodiment 11

The method of any of Embodiments 8 and 9, wherein covering the sensitive component with the polymer comprises encapsulating the sensor with a thermoplastic material.

Embodiment 12

The method of any of Embodiments 8 through 11, wherein impregnating the polymer with the hydrophobic material comprises impregnating a thermoplastic material with silicone oil.

Embodiment 13

The method of Embodiment 12, wherein impregnating the thermoplastic material with the silicone oil comprises impregnating the thermoplastic material with the silicone oil in a high-pressure and high-temperature environment.

Embodiment 14

A downhole tool, comprising at least one active device, the at least one active device comprising a sensor having a sensitive component; a polymer at least partially covering the sensitive component; and a hydrophobic material impregnated within the polymer.

Embodiment 15

The downhole tool of Embodiment 14, wherein the sensor is supported within a tool segment.

Embodiment 16

The downhole tool of any of Embodiments 14 and 15, wherein the tool segment is configured for attachment to a drill string.

Embodiment 17

The downhole tool of any of Embodiments 14 and 15, wherein the tool segment is configured for attachment to a wireline.

Embodiment 18

The downhole tool of any of Embodiments 14 through 17, further comprising an earth-boring tool.

Embodiment 19

The downhole tool of Embodiment 18, wherein the earth-boring tool comprises a drill bit.

Embodiment 20

A downhole tool, comprising an acoustic sensor, the acoustic sensor comprising a piezoelectric transducer; a hydrophobic material impregnated within the piezoelectric transducer; and a polymer at least partially covering the piezoelectric transducer.

Embodiment 21

The downhole tool of Embodiment 20, wherein the hydrophobic material comprises polydimethylsiloxane.

Embodiment 22

The downhole tool of any of Embodiments 20 and 21, wherein the acoustic sensor is configured to detect a signal in a downhole environment at, at least, 30 kpsi and at, at least, 175 degrees Celsius.

Embodiment 23

The downhole tool of any of Embodiments 20 through 22, wherein the hydrophobic material is impregnated within both the piezoelectric transducer and the polymer.

Although the foregoing description contains many specifics, these are not to be construed as limiting the scope of the present invention, but merely as providing certain embodiments. Similarly, other embodiments of the invention may be devised that do not depart from the scope of the present invention. For example, features described herein with reference to one embodiment or aspect also may be provided in others of the embodiments or aspects described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A downhole tool, comprising:
a sensor, the sensor comprising:
a sensitive component;
a polymer at least partially covering an outward-facing surface of the sensitive component; and
a hydrophobic fluid impregnated within at least one of the polymer and the sensitive component.

2. The downhole tool of claim 1, wherein the hydrophobic fluid is substantially evenly dispersed throughout the at least one of the polymer and the sensitive component.

3. The downhole tool of claim 1, wherein the hydrophobic fluid comprises polydimethylsiloxane.

4. The downhole tool of claim 1, wherein the hydrophobic fluid comprises at least one of a silicone-based oil, a non-polar silicone material, and a fluorocarbon.

5. The downhole tool of claim 1, wherein the sensor is configured to detect a signal in an environment at a pressure of at least 30 kpsi and at a temperature of at least 175 degrees Celsius.

6. The downhole tool of claim 1, wherein the sensor comprises an acoustic sensor.

7. The downhole tool of claim 6, wherein the sensitive component comprises a piezoelectric ceramic transducer.

8. The downhole tool of claim 1, wherein the polymer comprises a thermoplastic material.

9. The downhole tool of claim 8, wherein the thermoplastic material comprises polyetheretherketone.

10. The downhole tool of claim 1, wherein the sensor is supported within a tool segment.

11. The downhole tool of claim 10, wherein the tool segment is configured for attachment to at least one of a drill string and a wireline.

12. The downhole tool of claim 1, further comprising:
at least one active device comprising the sensor.

13. The downhole tool of claim 12, further comprising an earth-boring tool.

14. The downhole tool of claim 13, wherein the earth-boring tool comprises a drill bit.

15. The downhole tool of claim 1, wherein:
the sensor is an acoustic sensor; and
the sensitive component is a piezoelectric transducer, the piezoelectric transducer impregnated with the hydrophobic fluid.

16. The downhole tool of claim 15, wherein the acoustic sensor is configured to detect a signal in a downhole environment at, at least, 30 kpsi and at, at least, 175 degrees Celsius.

17. The downhole tool of claim 15, wherein the hydrophobic fluid is impregnated within both the piezoelectric transducer and the polymer.

18. A method of forming a downhole tool, the method comprising:
forming a sensor having a sensitive component;
at least partially covering an outward-facing surface of the sensitive component with a polymer; and
impregnating at least one of the polymer and the sensitive component with a hydrophobic fluid.

19. The method of claim 18, wherein at least partially covering an outward-facing surface of the sensitive component with a polymer precedes impregnating at least one of the polymer and the sensitive component with the hydrophobic material fluid.

20. The method of claim 18, wherein at least partially covering an outward-facing surface of the sensitive component with a polymer comprises at least partially covering the outward-facing surface of the sensitive component with polyetheretherketone.

21. The method of claim 18, wherein at least partially covering an outward-facing surface of the sensitive component with a polymer comprises encapsulating the sensor with a thermoplastic material.

22. The method of claim 18, wherein impregnating at least one of the polymer and the sensitive component with a hydrophobic fluid comprises impregnating a thermoplastic material with at least one of a silicone-based oil, a non-polar silicone material, and a fluorocarbon.

23. The method of claim 22, wherein impregnating a thermoplastic material with at least one of a silicone-based oil, a non-polar silicone material, and a fluorocarbon comprises impregnating the thermoplastic material with the silicone-based oil in a high-pressure and high-temperature environment.

* * * * *